United States Patent [19]

Phillips

[11] Patent Number: 4,969,642

[45] Date of Patent: Nov. 13, 1990

[54] BICYCLE TRAINER

[75] Inventor: Cal M. Phillips, Miami Beach, Fla.

[73] Assignee: RTS Trainer Corporation, Fort Lauderdale, Fla.

[21] Appl. No.: 461,097

[22] Filed: Jan. 4, 1990

Related U.S. Application Data

[63] Continuation of Ser. No. 193,677, May 13, 1988.

[51] Int. Cl.[5] ..... A63B 21/00

[52] U.S. Cl. ..... 272/73; 434/61

[58] Field of Search ..... 272/73, 131, 132, DIG. 4; 211/1, 17, 22; 434/61

[56] References Cited

U.S. PATENT DOCUMENTS

| | | | |
|---|---|---|---|
| 481,751 | 8/1892 | Engler . | |
| 591,969 | 10/1897 | Hiekisch . | |
| 2,198,058 | 4/1940 | Mobeck | 272/73 |
| 2,805,609 | 9/1957 | Littig . | |
| 2,972,478 | 12/1958 | Raiens . | |
| 3,352,426 | 11/1967 | Carlson . | |
| 3,368,809 | 2/1968 | Duane . | |
| 3,526,042 | 9/1970 | Nelson . | |
| 3,572,583 | 3/1971 | Lee . | |
| 3,589,717 | 6/1971 | Alexander . | |
| 3,686,776 | 8/1972 | Dahl . | |
| 3,724,844 | 4/1973 | Olmstead et al. . | |
| 3,735,981 | 5/1973 | Mallin . | |
| 3,866,908 | 2/1975 | Hangler . | |
| 3,871,648 | 3/1975 | Maurer . | |
| 4,021,034 | 5/1977 | Olesen . | |
| 4,026,546 | 5/1977 | Omori . | |
| 4,081,265 | 4/1978 | Berkes . | |
| 4,081,308 | 4/1978 | Hug . | |
| 4,262,899 | 4/1981 | Alvarez . | |
| 4,415,152 | 11/1983 | Smith . | |
| 4,421,308 | 12/1983 | Nagy . | |
| 4,423,863 | 1/1984 | Figueroa . | |
| 4,441,705 | 4/1984 | Brown | 272/73 |
| 4,505,473 | 3/1985 | Pro | 272/73 |
| 4,565,365 | 1/1986 | Barkhurst . | |
| 4,580,983 | 4/1986 | Cassini et al. . | |
| 4,593,898 | 6/1986 | McLerran et al. . | |
| 4,595,194 | 6/1986 | Previtali . | |
| 4,596,386 | 6/1986 | Sackl . | |
| 4,648,597 | 3/1987 | Adler . | |
| 4,674,742 | 6/1987 | Baatz . | |
| 4,768,782 | 9/1988 | Blackburn | 272/73 |
| 4,834,363 | 5/1989 | Sargeant et al. | 272/73 |

FOREIGN PATENT DOCUMENTS

| | | | |
|---|---|---|---|
| 2950605 | 6/1981 | Fed. Rep. of Germany | 272/73 |
| 475207 | 12/1967 | United Kingdom . | |

OTHER PUBLICATIONS

"The World of Clamping", De-Sta-Co, pp. 25-29 (1988).

*Primary Examiner*—Stephen R. Crow

*Attorney, Agent, or Firm*—Mark Lee Hogge; W. Mark Bielawski

[57] ABSTRACT

A bicycle trainer has a horizontal frame. Pivotal hub capturing supports are attached to the frame. A bicycle wheel hub is situated between the supports where opposed hub capturing strucuture attaches to the hub and holds the wheel secure and upright. At least one of the supports has a quick release for capturing. The quick release has a piston with a socket for fitting around the hub. The socket on the piston is urged towards the hub by a spring biased cam having a lever attached thereto. The structure supporting the rear wheel of a bicycle may be used to support the front of the bicycle. The rear and front wheel portions may be connnected by a telescoping arrangement to allow for different lengths in bicycles. The rear tire rests upon and is in frictional engagement with a roller attached to the frame. The roller is tensionable by way of a brake actuated with an easily accessible push-pull cable. The roller supporting the front tire is not provided with a brake but is connected to the rear roller by an endless belt.

5 Claims, 8 Drawing Sheets

BICYCLE TRAINER

This application is a continuation of my prior application U.S. Ser. No. 193,677filed May 13, 1988.

BACKGROUND OF THE INVENTION (1) Technical Field

This invention relates to bicycle stands for pedaling a bicycle while in an upright stationary position. In particular, the present invention relates to a stationary bicycle trainer (dual drive or singular drive) that accommodates any wheel base or size, has lockable quick release means, is light-weight and pivotally compact, and has a tensionable roller.

(2) Background Information

The prior art that relates to this invention are of two general types. They are either road travel simulators whereby both wheels of a bicycle engage one or more rollers causing both wheels to rotate when pedaling the rear drive or they are tri-pod like trainers for the rear of a bicycle that telescope and adjust in various ways to accommodate different size wheels and they are dual drive stationary trainers.

For stationary trainers, the art is headed in a technical direction utilizing computers for tracking time, distance, average speed, top speed, number of calories burned, heart rate, and even tracking previous workout comparisons. All these computer add-ons are a visual motivational means for a work-out and can be added to any bicycle. Motivation is a factor involved in any work-out and ease of hook-up of a bicycle to a trainer can either make or break the motivation.

The prior art pertaining to rear wheel trainers have all attempted to accommodate different size wheels and provide a collapsible quick-release trainer. Thus far, as evidenced in the marketplace, no such quick release trainer exists. The prior art that is truly quick release adds permanent structure to the bicycle for the quick hook-up; this has not been accepted in the marketplace.

The road travel simulators that have rollers for both the front and rear wheels are either too difficult to ride or too cumbersome for easy use. In the prior art most trainers have no tension on the rollers. There are very few patents on dual drive stationary trainers even though, in the marketplace, the trend is toward getting the upper body involved as well. As an example, U.S. Pat. No. 3,352,426 to Carlson discloses a horizontal and vertical adjustable rear wheel trainer. However, there is no means for tensioning the roller and there is no quick release means.

U.S. Pat. No. 4,421,308 to Nagy illustrates a common practice in the prior art with an attempt at a quick release means. Nagy permanently attaches extra structure to the axle of a bicycle to accomplish a quick release means. This is unacceptable in the industry because of added weight and no one wants to permanently attach anything extra to their bicycle. Nagy provides a roller for the rear wheel to rotate upon but fails to provide a means for tensioning the wheel.

Most of the supportive stand type trainers attach by some means to the axle and support the weight of the bicycle as well as the rider off the ground. The roller is then tightened down onto the tire to cause tension. The more pressure on the tire the harder the work-out. U.S. Pat. No. 3,735,981 to Mallin uses this method. This type of roller tensioning and off-the-ground support is a disadvantage in that it does not simulate road conditions and it puts undue stress on the axle as well as on the tire. Pushing against the tire as a means of tensioning the roller is not a good system. It causes unnatural wear on the tire.

In the past two years or so there have been some innovative computer hookups to bicycles and trainers alike that trace time, distance, speed, rpms, even heart rate. Most of these have sensors on the front wheel to take advantage of the short distance from the mounting area on the handle bars of the read out apparatus to the front wheel. Hence, there are cable length savings by not having the sensor on the rear wheel. These very popular read-outs are not possible when the rear wheel trainers are used. If a front and rear roller trainer is used, then distance can be accurately tracked. Most people who train usually ride "X" number of miles. This is a disadvantage for rear wheel trainers.

The prior art on roller trainers simulate road travel, but the average person cannot easily ride the prior art devices without lengthy practice because of lack of up-right support. See for example U.S. Pat. No. 3,871,648 to Maurer, III. While some roller trainers show some form of support, for example U.S. Pat. No. 4,415,152 to Smith and U.S. Pat. No. 4,580,983 to Cassoni et al., none have been widely accepted in the industry because of their cumbersome nature.

.U.S. Pat. No. 481,751 to Engler shows a trainer wherein the rear wheel is supported and rotatable on two small rollers and the front of the bicycle is supported by two uprights attachable to the front fork. The intent of this invention is for cleaning and displaying purposes. There is no means for tensioning the rollers. It appears to attach to the painted surface of the front fork, which is not desirable. This invention has no means to just support the rear wheel.

U.S. Pat. No. 591,969 to Hiekisch discloses a bicycle stand which is adapted to support the rear wheel of a bicycle. The apparatus does not appear to be adapted for training purposes. The intent of this patent is to provide a display stand for a bicycle. There is no means provided for tensioning of the wheel to simulate road travel; hence it is not meant for training purposes. Tools are required to adjust and tighten the nuts for axle width adjustments. The device of Hiekisch is not securable and lockable.

U.S. Pat. No. 2,805,860 to Littig discloses a bicycle roller trainer. The rear wheel of the bicycle is supported between two rollers. The bicycle is connected to the trainer by a clamp situated at a mid portion of the bicycle. It is not quick release and discloses no means for tensioning the rollers.

U.S. Pat. No. 2,972,478 to Raines discloses a rear wheel trainer. The rear wheel of a bicycle is supported by a stand having a roller located thereon. The device of Raines has a tensionable roller that adjusts to the wheel. The axle supports are not quick release and the tension is applied to the wheel of the bicycle and not the roller itself. If a child's bicycle were put on the stand, the rear wheel would be lifted far off the ground in an unnatural riding position. It is more desirable to lower the wheel to the roller. No means to lock the bike to the stand is disclosed in Raines.

U.S. Pat. No. 3,368,809 to Duane discloses a bicycle stand. The rear wheel of the bicycle is situated upon a roller.

U.S. Pat. No. 3,526,042 to Nelson discloses a motorcycle training apparatus. Both wheels of a motorcycle are supported by rollers. The front and rear support structure is connected with and endless chain.

U.S. Pat. No. 3,572,758 to Lee discloses a bicycle trainer. The rear wheel of a bicycle is supported between two rollers.

U.S. Pat. No. 3,589,717 to Alexander discloses a bicycle training apparatus wherein the rear wheel is supported by a roller.

U.S. Pat. No. 3,686,776 to Dahl discloses a motorcycle riding simulator. The front and rear tires are supported by rollers which are connected by an endless chain.

U.S. Pat. No. 3,724,844 to Olmstead et al. discloses a bicycle training device for the rear wheel of a bicycle. The tension is applied to the tire and not the roller. It has no quick release means and has fastening means attached to painted surfaces of the bicycle. These are all undesirable characteristics. Also, a childs bicycle tire would not reach the roller.

U.S. Pat. No. 3,866,908 to Hangler discloses a bicycle conversion stand. The tri-pod like trainer for the rear wheel of the bicycle is situated upon a roller. Tension is applied by tightening the roller to the bicycle tire. This does not allow smooth rotation of the rear wheel. There is no quick release means. Also, a childs bicycle could not be used on this trainer, hence, all wheels cannot be accommodated.

U.S. Pat. No. 4,021,034 to Olesen discloses a stand for converting a conventional bicycle for indoor exercising. The stand includes a roller supporting the rear wheel.

U.S. Pat. No. 4,026,546 to Omori discloses a bicycle pedal stand. The rear wheel of the bicycle is supported by rollers.

U.S. Pat. No. 4,082,265 to Berkes discloses a bicycle supportive system. The front and rear wheel of a bicycle are supported by rollers. There is structure attached to the bicycle seat support for securing the bicycle on the system. This invention suffers from lack of quick release means and lack of means to tension the rollers. There is also lack of adjustment for children size wheel bases.

U.S. Pat. No. 4,082,308 to Hug discloses a bicycle type of training apparatus. The rear wheel of the bicycle is supported between two rollers. The bicycle is secured to the apparatus by means of support rods attaching to the bicycle frame.

U.S. Pat. No. 4,262,899 to Alvarez discloses a rear wheel trainer where the tension is applied by sliding the roller closer and tighter to the tire of a bicycle. This is accomplished by kicking the slider and is not an acceptable means of accurate tensioning.

U.S. Pat. No. 4,423,863 to Figueroa discloses an exercising device. A dual drive bicycle is mounted on an exercising device where untensionable rollers are applied to top portions of front and rear tires.

U.S. Pat. No. 4,565,365 to Barkhurst discloses an exercise device. A stand for a bicycle supports the rear wheel of the bicycle between two rollers. Upright support members attach to the bicycle seat support frame member.

U.S. Pat. No. 4,593,898 to McLerran et al. discloses a bicycle exercising means and method. A rear wheel of a bicycle is supported by a stand. A flywheel is applied to a side of the rear tire to provide drag. The flywheel is slidably adjustable to provide more or less centrifugal force to tension the wheel; while innovative, the device of McLerran et al. is cumbersome. Also, different fittings are necessary to accommodate different hubs. The invention suffers from lack of quick release means and lack of means to tension the rollers. There is also lack of adjustment for children size wheel bases.

U.S. Pat. No. 4,595,194 to Previtali discloses a bag portable bicycle training apparatus. A foldable bicycle trainer has structure to support a rear wheel of a bicycle wherein the bicycle tire rests upon a roller. Previtali falls to provide a true quick release means. His type of axle attachment is not convenient nor quick to install or release. This type of attachment, during use, further tightens itself onto the axle and is then impossible to detach without the use of a tool. There is no means to attach the very popular wind load simulator fan for a means of tensioning.

U.S. Pat. No. 4,596,386 to Sackl discloses an exercise device. A rear wheel of a bicycle is supported between two rollers.

U.S. Pat. No. 4,648,597 to Adler discloses a bicycle support device. What appears to be a jack stand is connected to the bicycle frame near the pedal crank. The stand has a roller in frictional engagement with a side of a tire.

U.S. Pat. No. 4,674,742 to Baatz discloses a windload simulator for a bicycle. A stand is provided for supporting the rear wheel of a bicycle off the ground. A windload simulator has a roller in frictional engagement with the top portion of a tire. Baatz fails to provide a quick release means. This means of tension on the wheel simulates wind load, but it fails to simulate a steep hill climb.

In conclusion, it becomes fairly obvious from studying the market and the prior art that the bicycle riding public would like to have several important features. The most important feature being a quick and painless release means. The prior art tries to accomplish this in various ways that is thus far unacceptable in the marketplace. Another important feature that is sought is a means of accommodating any size wheel and wheel base. Yet another feature that is attempted in the prior art is a means of tensioning the wheel to simulate road travel.

The aforementioned prior art suffers from complexity or cumbersome mounting methods or lack of portability. There is a long felt but unsolved need in the prior art for a bicycle trainer wherein any bicycle may be easily mounted and various terrain simulated.

SUMMARY OF THE INVENTION

The beauty of some inventions is in their simplicity. Simplicity allows for ease of manufacture and pleasing aesthetics. The present invention has a substantially horizontal frame which telescopes at a couple of points to provide a support for various lengths of bicycles. There is a pair of pivotal upright supports between which a rear bicycle wheel is situated. A bicycle wheel is placed between the upright supports and the bicycle hub is captured by certain structure located on the upper most ends of the uprights. Once captured and secure, the rear bicycle wheel is then allowed to move forwardly while the uprights pivot about the frame forwardly to bring the tire to rest on a roller. The pivotal uprights allow for various bicycle wheel diameters.

The structure used to capture the hub comprises a quick release, spring loaded, cam actuated socket opposed by a screw socket. The quick release is situated on one upright and the screw release is situated on the other upright. It should be noted that two opposed quick release apparatus may be used but in practice, it has been discovered that, in fact, only one quick release structure is needed. Once the initial fitting for the screw release has been set, only the quick release structure is manipulated, unless, of course, a different sized bicycle is used. In operation, the hub of the bicycle is held between the capturing structure and the screw socket is extended to fit about the hub nut. The opposed quick release structure is put into place and the bicycle wheel is then captured.

The quick release comprises a piston axially slidable in a housing. The housing and the axis of the piston are perpendicular to the pivotal upright supports. The piston is slidable both towards and away from the opposed screw socket. On the surface of the piston facing the opposed screw socket is a socket for capturing the bicycle wheel hub. The surface of the piston facing away from the opposed screw socket is acted upon by a cam. Attached to the cam is a lever for manually actuating the cam. As the lever is raised or lowered, the cam urges the piston forward or a spring bias attached to the cam pulls the piston rearward. The cam is lockable so that a bicycle wheel may be secured from theft when locked on the invention.

Once the bicycle wheel has been secured and the uprights pivoted forward to bring the bicycle tire into a resting place on the roller, training may take place. A bicyclist may mount the bicycle and pedal away. The roller is tensionable so that varying degrees of torque are necessary to pedal the bicycle. Tension is provided by a brake with pad which is rotated on a portion of the roller axle towards or away from the roller. The more pressure the brake pad exerts on the roller the more force is necessary to make the pedals of the bicycle rotate. The manipulation of the roller brake is by a push-pull cable accessible while the rider is on the bike.

The invention contemplates adapting to a double drive bicycle currently disclosed in commonly owned U.S. patent application Ser. No. 031,745, filed March 30, 1987. (incorporated herein by reference). Thus, if one were to desire to train with a dual drive bicycle, the invention provides support structure for the front wheel which is substantially the same as the structure for supporting the rear wheel. The horizontal frame portion is telescoped to the appropriate length of the bicycle. Both the front and the rear wheels are secured. Both the front and rear tires are resting on rollers. Preferably, the front roller is not provided with a brake. Rather, the rear roller is connected to the front roller by an endless belt. Thus, rotation of the foot pedals of the bicycle rotates the rear wheel, whereupon the tire rotates the rear roller. Rotation of the rear roller rotates the front roller along with the front tire and wheel. Tension that is applied to the rear roller is transmitted to the front roller by the endless belt. Because the bicycles may vary in length, the endless belt is spring biased to provide resistant play at an anchoring point.

The invention can be adapted as a bicycle carrier mounted on a car. The invention may be placed upon the roof of a car and straps may be used to secure the frame to the roof gutters or side windows. A bicycle may be placed in the trainer and the bicycle and trainer may be driven away, neat and secure.

The invention may be adapted for a group exercise situation. A plurality of trainers may be connected in adjacent fashion where there is sharing of common frame members. Groups of enthusiasts may train together. Such a plural training apparatus may be set up at playgrounds. Of course, materials should be used to construct the plural arrangement such that compatibility with the outside elements is provided.

It is an object of this invention to provide a support stand for a bicycle that is inexpensive to manufacture, lightweight and portable and has many applications.

It is a further object of this invention to provide a quick release mechanism that literally takes just seconds for set up and take down without attaching anything permanently to the bicycle.

It is a further object of this invention to provide a stand with a tensionable roller to be used as a stationary trainer for a front or rear wheel or a bicycle.

It is a further object of this invention to provide a locking means to a quick-release stand for a bicycle so as to be able to secure the bicycle to a permanent stand.

It is a further object of this invention to provide a bicycle stand that has pivotal legs which first engage the axle of a bicycle and then pivot and lower the weight of the bicycle to the roller. The weight of the bike and rider is on the roller and the axle. This is an advantage in that it exactly simulates what happens on the road. Pressure on the tires is exactly simulated, therefore road friction is the same.

It is a further object of this invention to provide a tensioning means to the roller, (not the tire) from zero tension to enough to stop the rider, therefore simulating any terrain.

It is a further object of this invention to provide a supportive stand or stands that are similar in nature that when they are attached by means of two bars and a pulley, combine to form a supportive, tensionable, road travel roller simulator that accommodates any size wheel base (childrens as well as adult bikes) and accurately, by the use of a computer, tracks distance, time, heart rate, calories burned, and any other computer tracking known to bike trainers.

It is a further object to provide a quick release, lockable roof rack for a car by means of straps and gutter clips.

It is a further object to provide a dual drive "stationary bicycle", (front and rear drive), that closely simulates road travel and that has tensionable rollers connected by a belt, so that if the rear drive or the front drive is under power both wheels spin.

.It is a further object of this invention to provide a quick release supportive stand for the front wheel of a bicycle, or the rear wheel of a bicycle that is securable and lockable.

These and other further objects and features of the invention are apparent in the foregoing and ongoing specification claims and drawings.

BRIEF DESCRIPTION OF THE DRAWINGS

While the specification concludes with claims particularly pointing out and distinctly claiming the subject matter that is regarded as forming the present invention, it is believed that the invention will be better understood from the following description accompanied by the following drawings in which:

DESCRIPTION OF THE PREFERRED EMBODIMENT

The best mode for practicing the invention is disclosed in FIGS. 1–13. The invention is a device for mounting a bicycle which enables a bicyclist to ride the bicycle in place. Structure and function is supplied for varying drive load of the bicyclist, whereby a variable terrain is simulated.

Figure 1:
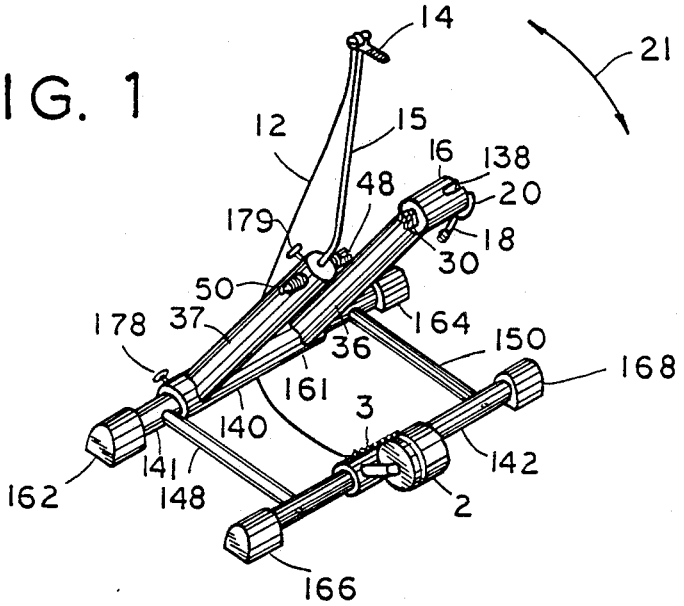
FIG. 1 is an elevated perspective of a single bicycle wheel trainer.

Referring to FIG. 1, there is shown a frame consisting of a base portion, comprising two mutually spaced front and rear substantially horizontal frame members 141 and 142. Two parallel spacing bars 148 and 150 connect said front and rear base members. Connecting frame members 141 and 142 are substantially horizontal frame members 148 and 150. The connecting of the frame members is performed by any suitable method well known to those ordinarily skilled in the art. Cushion members 162, 164, 166 and 168 are provided to protect the ends of frame members 141 and 142 to protect a flat surface having the frame structure resting thereon.

Figure 8:
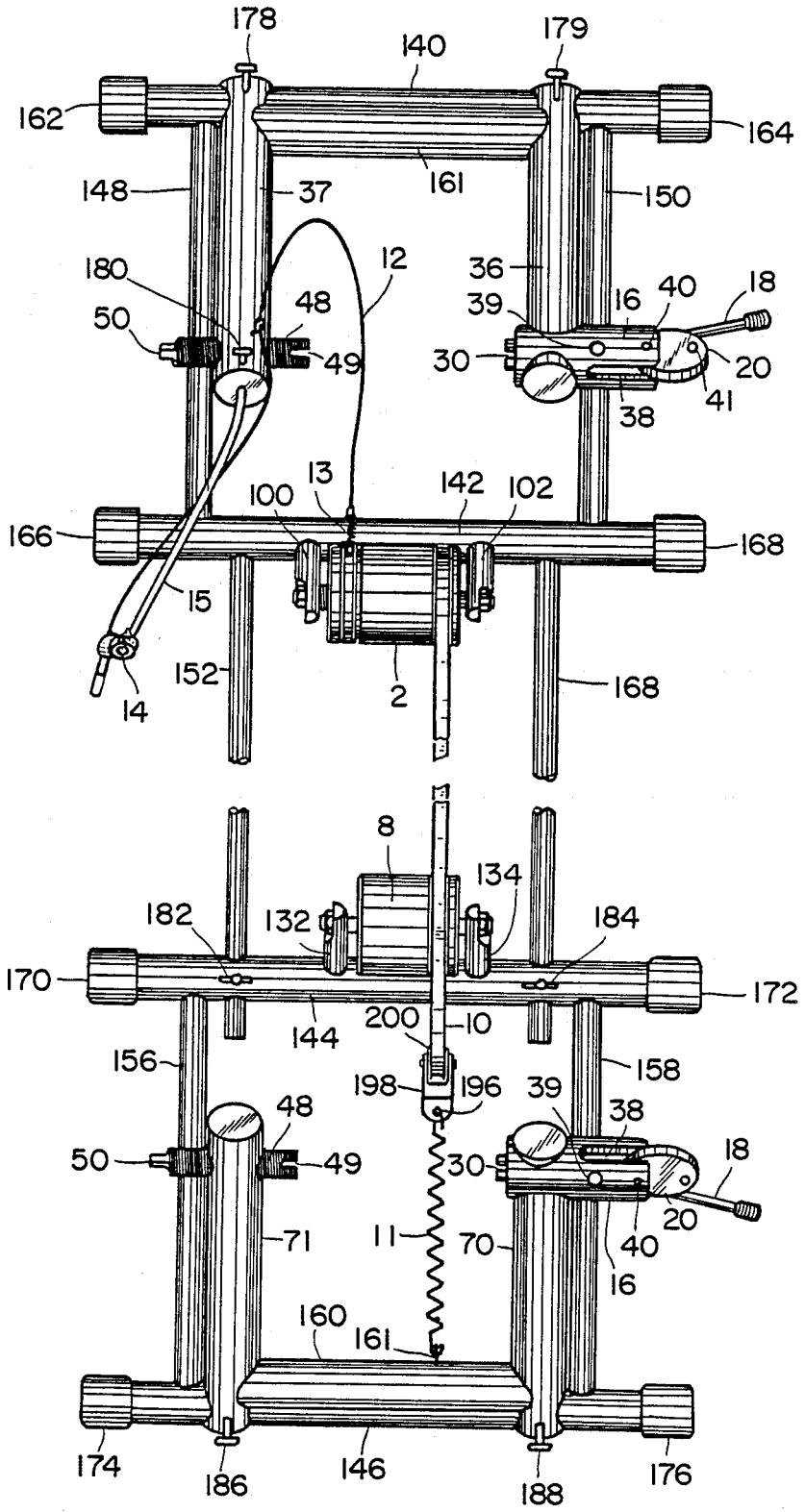
FIG. 8 is a top plan view of a dual drive bicycle trainer.
Figure 13:
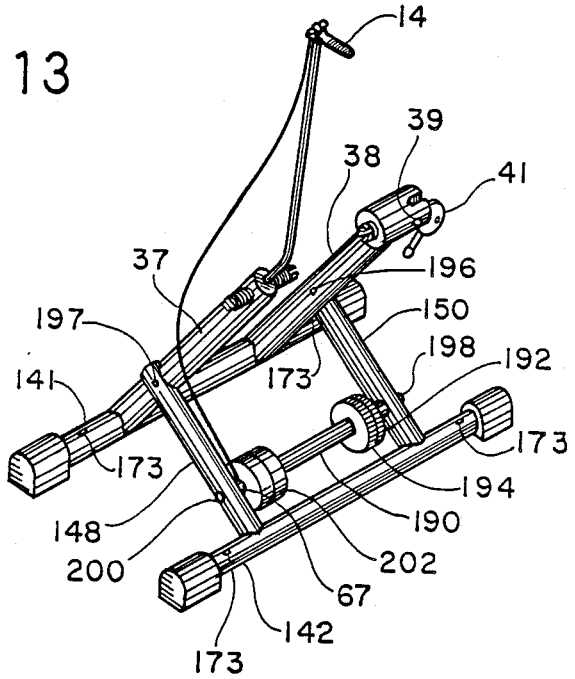
FIG. 13 is an elevated perspective of another embodiment of the invention.

Coaxial sleeve 140 is mounted on the rear base member frame member 141 and is rotatable thereabout. Elements 178 and 179 are bolts to tighten sleeve 140 to frame member 141. Upright frame extensions 36 and 37 (hereafter known as legs) are fixedly and perpendicularly attached to coaxial member 140. Legs 36 and 37 support a bicycle wheel axle. Once leg position for particular bicycle is found, then 178 and 179 are tightened and this position is maintained for convenience. If various size bicycles are in constant use, then 178 and 179 are not used. It should be noted that there are various ways to attach the base portion of the frame and still maintain the advantageous pivotability that allows the accommodation of all wheel sizes in the bicycle industry. FIGS. 8 and 13 provide examples of such embodiments.

Quick release means are provided at the terminal end of leg 36. The quick release means are more fully described in FIG. 4. Handle 18 is attached to cam 20. Cam 20 rotates through slot 38 to urge piston 26 having socket 30 located at the end towards the opposed upright leg 37.

Towards the terminal end of leg 37 is a threaded release means 48, 50. Threaded member 50 is rotated to urge the end of the threaded member bearing a socket 48 towards the opposed upright leg 36. It should be noted that socket 48 is threaded to a distance that works in cooperation with the throw of ca 20. Once this distance is determined for a particular bicycle, the quick release mechanism is the only thing necessary to operate to engage or disengage the bicycle.

Threaded socket member 48 and cam actuated socket member 30 are adapted to capture and hold securely the hub of a bicycle wheel. Lever 18 is attached in a fixed manner to cam 20. To release a bicycle from the stand, the lever 18 is moved in a position as in FIG. 4.

Rod 15 is attached to leg 37. At the end of rod 15 there is mounted a tension lever 14. Lever 14 pushes or pulls push-pull cable 12 which is attached to tensionable roller 2. Tensionable roller 2 is better shown in FIG. 6.

Figure 2:
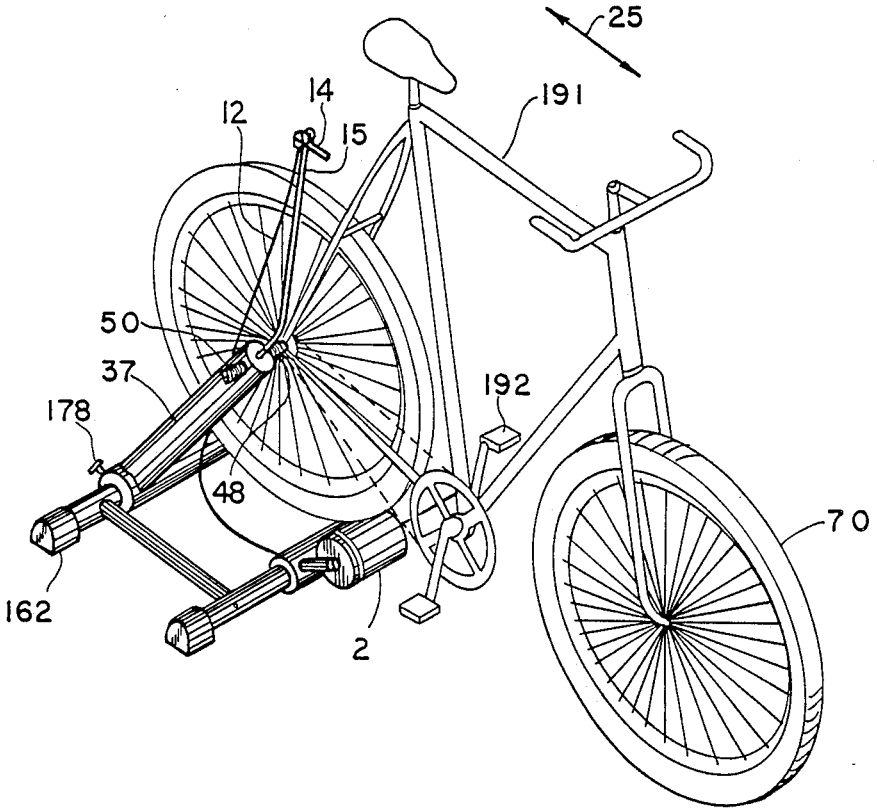
FIG. 2 is an elevated perspective showing a bicycle mounted on the apparatus of FIG. 1.

Referring to FIG. 2, a bicycle is shown mounted on the apparatus of FIG. 1. The rod 15 is shown in close proximity to the seat of the bicycle; this is for easy access by a rider to adjust tension on the roller. As the pedals 192 are rotated by a bicyclist situated on the bicycle of FIG. 2, the rear wheel of the bicycle rotates tensionable roller 2.

Typically, the hub of the bicycle is captured by the sockets 30 and 48, whereupon the legs 37 and 36 are pivoted forward to bring the tire in a resting position upon the roller 2. This method of engaging the axle of a bicycle then pivoting forward and lowering the bicycle to the roller accomplishes two things: one, it is the means of accommodating all wheel sizes; and two, it saves the step of adjusting the roller to the wheel.

Figure 3:
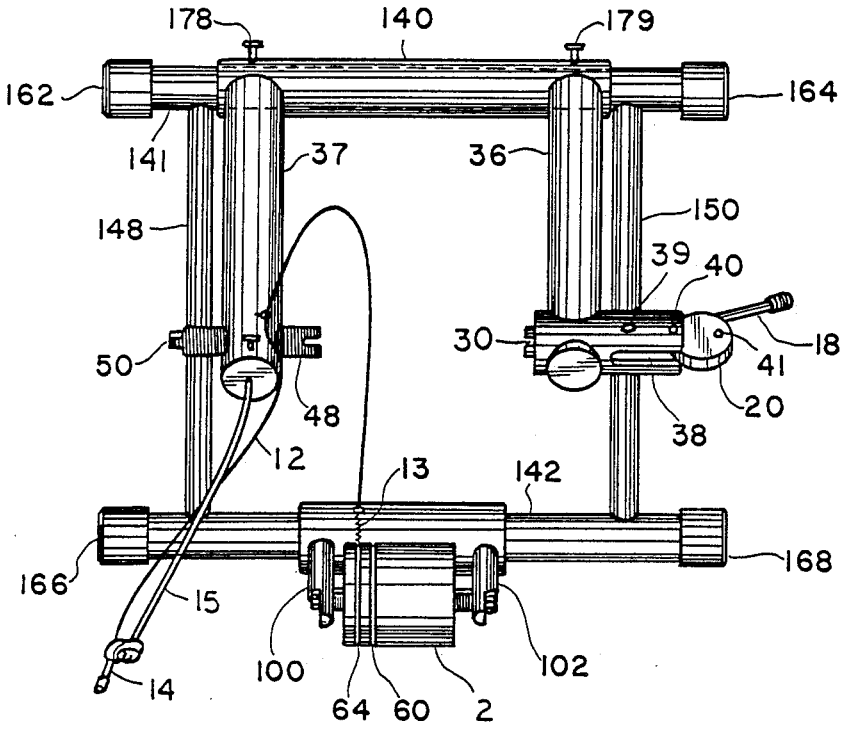
FIG. 3 is a top plan view of the apparatus of FIG. 1.

Referring to FIG. 3, there is shown the apparatus of FIG. 1 from an elevated plan perspective. The frame comprises rear member 141 connected to front member 142 by connecting and spacing rods 148 and 150. Coaxial with rear frame 141 and rotatable thereabout is coaxial sleeve 140. Set screws 178 and 179 allow for fixing of the position of coaxial sleeve 140 about rear frame member 141.

It is preferred that the screw socket member 50, 48 be adjusted to capture one side of a bicycle hub, whereupon the quick release member having socket 30 may be quickly moved to capture the other side of the bicycle hub.

Figure 4:
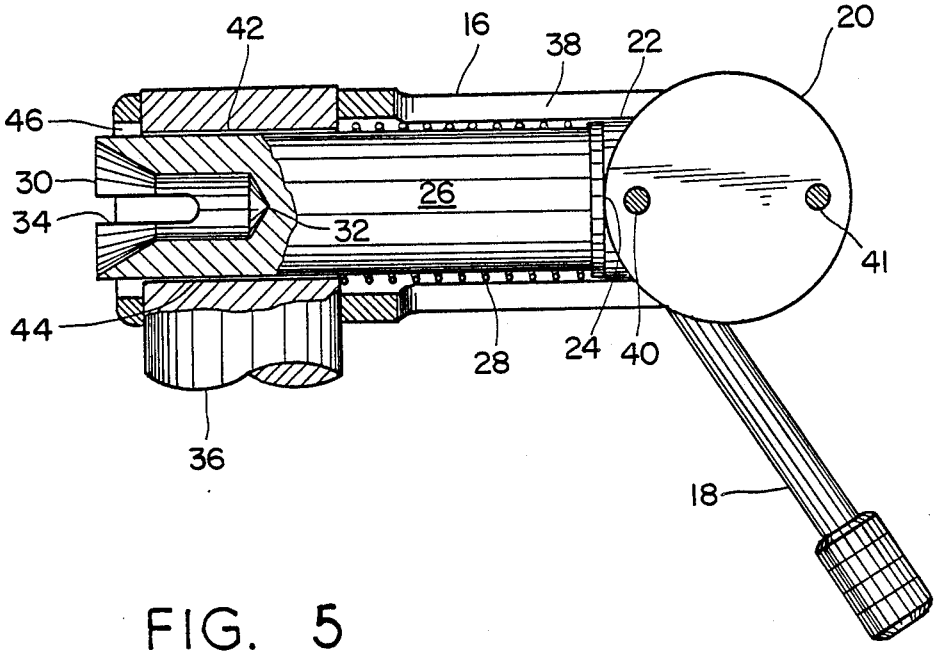
FIG. 4 is a side plan view in partial cutaway of the quick release means.
Figure 5:
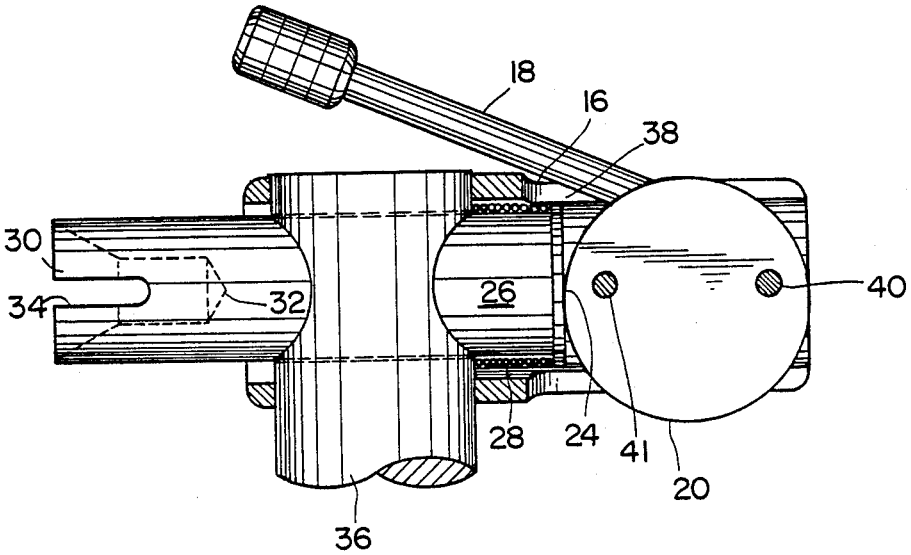
FIG. 5 is another front plan view the apparatus of FIG. 4 showing the quick release means in a fully extended position.

Referring to FIGS. 4 and 5, the quick release means is fully shown. Lever or handle 18 is attached in fixed manner to cam wheel 20. As the cam wheel 20 is rotated in counter clockwise manner through groove 38, the camming surface abuts piston end 24 to urge piston 26 through upright bicycle axle support 36. A channel defined by walls 42 and 44 in the housing 16 is adapted to slidably receive the piston 26. It is preferred that a spring bias 28 be connected to quick release housing 16 and piston 26 to resist the urging of the piston through channel 42, 44 towards a bicycle hub.

On the end of piston 26 is located socket 30. Socket 30 is provided with a slot 34 which longitudinally extends partially through the slot socket. Slot 34 is to adapt to a quick release lever which may be present on a bicycle hub. The end of the socket 32 is concave to receive a nut or other hub attaching structure. The housing of the quick release means 16 is shown extending through the upright 36 with the opening around the socket 46 slightly larger then the diameter of the piston 26.

In FIG. 5, the piston 26 is shown being fully extended towards a hub. The spring 28 is shown in compressed mode. Thus, the spring bias 28 urges the piston back towards the position of FIG. 4. Pin 40 attaches lever 18 to cam 20. Hole 41 on the cam wheel 20, when in the position of FIG. 5, may be aligned with a hole in housing 16 wherein a latchbolt detent may be used to hold the configuration of FIG. 5 in place.

Figure 6:
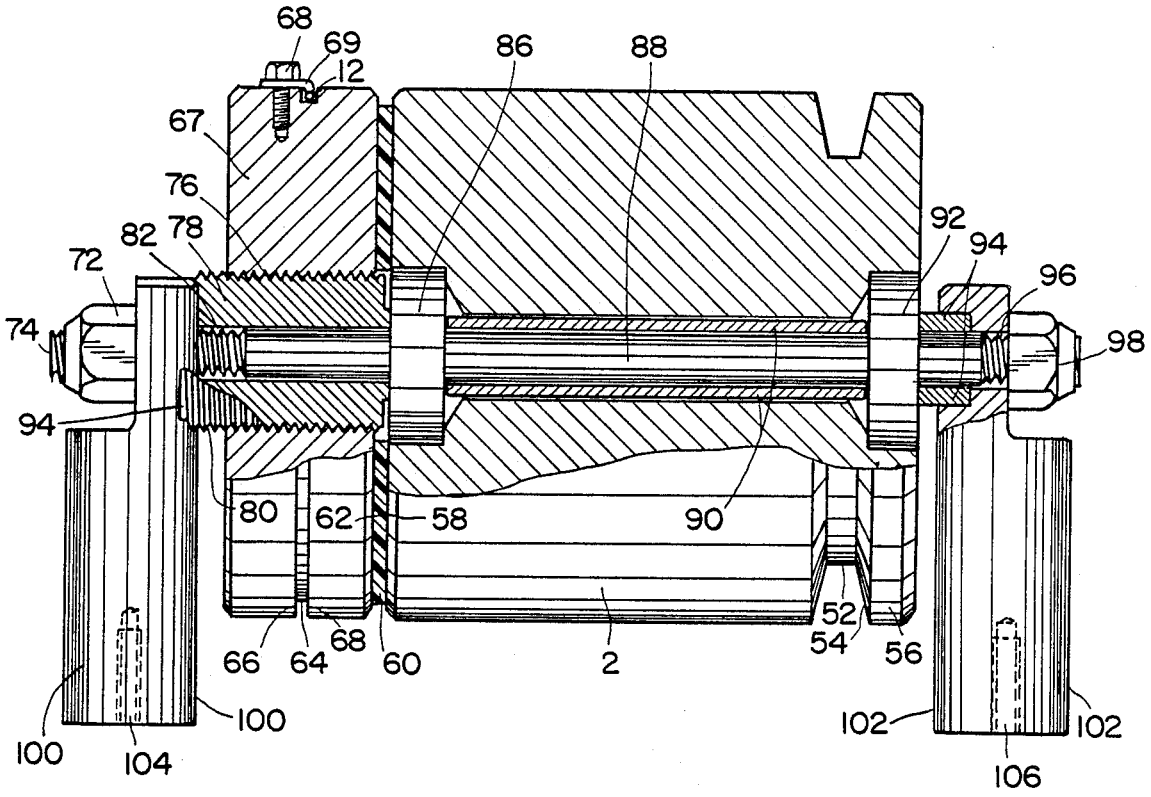
FIG. 6 is a front plan view of a tensionable roller partial cutaway.

FIG. 6 fully discloses the tensionable roller. The roller drum 2 is adapted to have a bicycle tire rest thereon and rotate therewith. Frame upright 100 and 102 are axle supports. Axle supports 100 and 102 support axle 88. The axle supports 100 and 102 are attached to the front frame 142 in much the same manner that hub supports 37 and 36 are attached to rear frame member 141. Axle 88 has threaded ends 96 and 82 which are received in axle supports 102 and 100. The ends of the axle 88 are secured with fastening elements 72 and 98. The connecting of the axle supports is performed by any suitable method well known to those skilled in the art.

Roller drum 2 is journaled onto axle 88 by way of bearings 92 and 86. Preferably, bearings 92 and 86 are fixably mounted in the ends of roller drum 2. Bushing 90, being coaxial to axle 88 acts as a spacer between bearings 86 and 92. Bushing 94 acts as a spacer between bearing 92 and axle support 102.

Tensioning member 67 is preferably a thick disk threadably mounted on exteriorly threaded sleeve 78. Sleeve 78 is fixably mounted on axle 88. There is an indentation in sleeve 78 at point 80 to indicate that sleeve 78 is fitted to a portion of the arc of the circumference of axle support 100. Point 94 of sleeve 78 shows the arcuate fit. The arcuate fit prevents movement of sleeve 78.

Situated between tensioning member 67 and roller drum 2 is friction pad 60. Friction pad 60 may be fixedly attached to either the roller drum 2 or the tensionable member 67.

In operation, push-pull cable 12 is connected to tensioning member 67 by way of threaded fastener 68 and 69. The push-pull cable 12 rotates tensioning member 67 on threaded sleeve 78 either towards roller drum 2 or away from roller drum 2. Groove 64 defined by walls 66 and 68 on tensioning member 67 defines the area confining push-pull cable 12. When tensioning member 67 is urged towards roller drum 2, braking occurs. Thus, hilly terrain is simulated.

Figure 7:
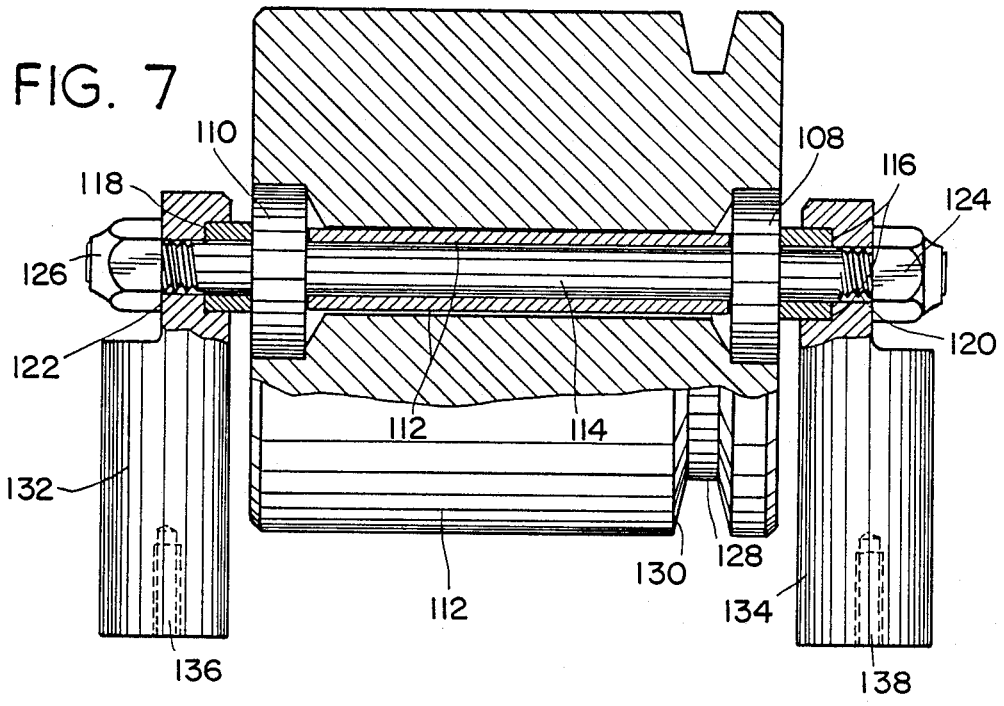
FIG. 7 is a front plan view of a non-tensionable roller in partial cutaway.

FIG. 7 discloses a roller drum 8 which is not tensionable. Roller 8 acts as a momentum weight when the bicycle is not under power. The roller of FIG. 7 may be used for a road travel simulator as in FIG. 8 on the forward section of the trainer.

The rollers of FIGS. 6 and 7 may be connected by way of an endless belt such as a V-belt positioned in groove 52 of FIG. 6 and groove 128 of FIG. 7. Connecting features 104, 106, 136 and 138 of the axle supports of FIGS. 6 and 7 is an indication of affixed attachment means.

FIG. 8 shows a dual supportive bicycle trainer adapted for two wheel drive simulation to closely simulate actual riding conditions whether on a single rear drive bicycle or on a dual drive bike. Rollers 2 and 8 are connected by endless belt 10 so that when either wheel is under power both wheels will spin. The rear wheel trainer is attached to the front wheel trainer by way of extension connecting members 152 and 154. Connecting members 152 and 154 are shown broken to indicate there may be considerable more extension then shown in FIG. 8.

Roller 8 is the structure disclosed in FIG. 7. The V-belt 10 is situated in a pulley 200 which is attached to a bracket 198 having spring connecting hole 196 located thereon. Spring 11 maintains tension on belt 10 when connected to frame member 160 by way of fastening element 161. The front wheel drive portion of the trainer of FIG. 8 is much the same as the rear wheel trainer section disclosed in FIG. 3. An expandable rubber band could be used to connect said rollers and said rubber band could be expandable enough to accommodate most wheel bases.

The front section has a quick release means 30 and a screw release means 49. It should be stated that it is conceivable that the opposed axle hub capturing apparatus disclosed in this invention may include two opposed quick release means.

The bicycle axle hub supports 36 and 37 on the rear part of the trainer and the bicycle axle hub supports 70 and 71 on the front part of the trainer of FIG. 8 are shown to be connected to frame supports 140 and 146 in a slightly different manner than what is disclosed in FIG. 3. In FIG. 8, axle supports 36 and 37 are shown to be pivotal around frame number 140 in such a manner that frame member 140 extends through and between the bicycle hub supports 37 and 36.

Figure 9:
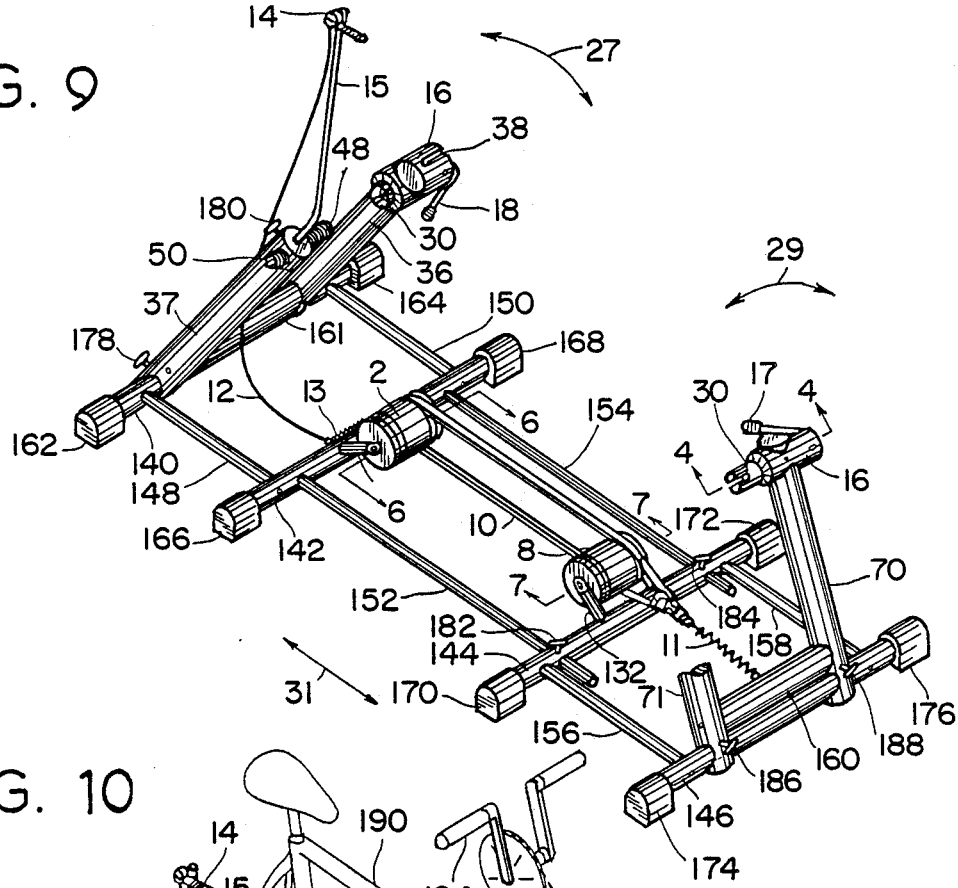
FIG. 9 is an elevated perspective of the apparatus of FIG. 8.

FIG. 9 shows the apparatus of FIG. 8 from a perspective point of view.

Figure 10:
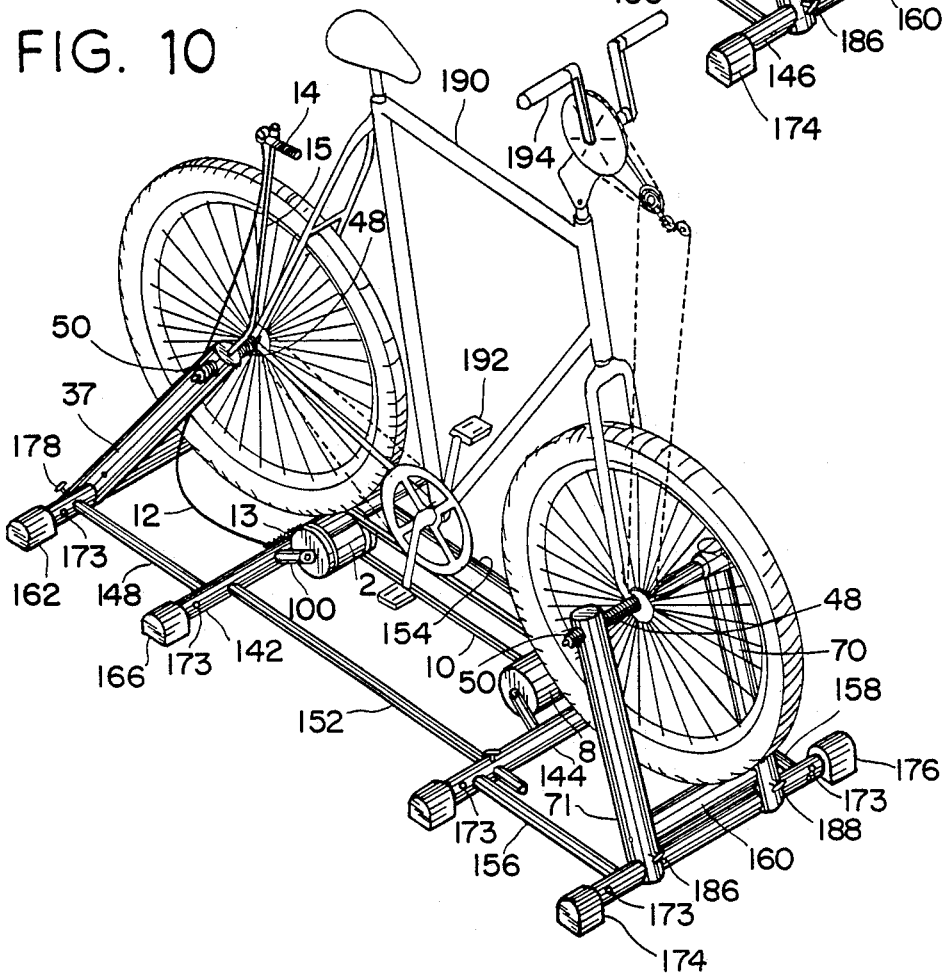
FIG. 10 is an elevated perspective of the apparatus of FIG. 9 showing a dual drive bicycle mounted thereon.

FIG. 10 shows a bicycle having a front wheel drive mounted on the apparatus of FIG. 9. This "Dual Drive Stationary Bicycle Trainer" enables the rider to work all muscle groups in an aerobic manner. Being that tensionable roller 2 is connected to roller 8 by means of a belt 10, someone could conceivably just work the upper body while on this trainer and do so under varied selected tensions. One could also do the same for the legs or one could work both upper and lower body.

Figure 11:
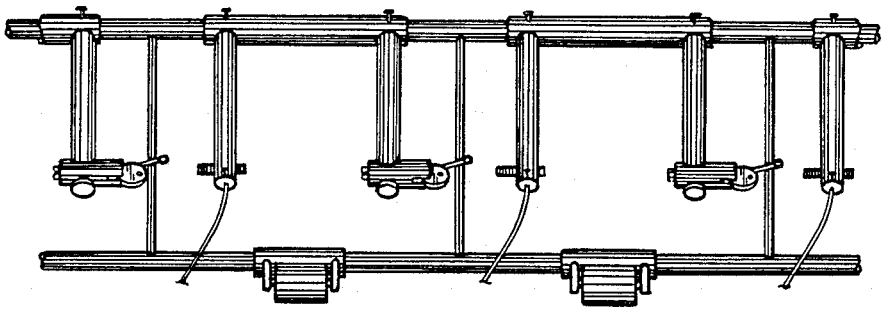
FIG. 11 is a top plan view of a series of trainers as shown in FIG. 3.

FIG. 11 shows how a series of apparatuses shown in FIG. 3 may be set up. It is conceivable that the apparatus in FIG. 11 can accommodate a large number of bicycles and would be well suited for a fitness center or even a playground. The rollers would be optional for the playground mode if a plural bike stand is desired.

Figure 12:
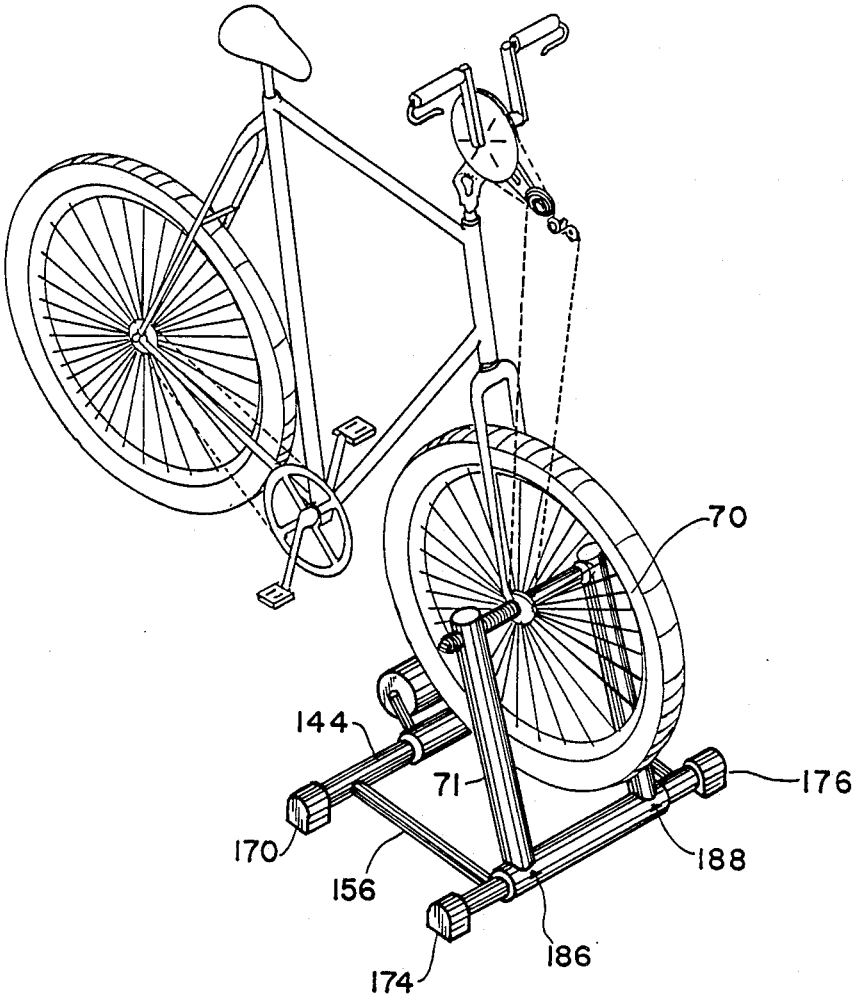
FIG. 12 is an elevated perspective showing a trainer such as shown in FIG. 3 with only a front wheel drive of a bicycle mounted thereon.

FIG. 12 shows how the bicycle trainer can be adapted for only a front wheel drive system and also illustrates how the apparatus can be used as a quick release supportive stand that is lockable.

Referring now to FIG. 13, there is shown another preferred embodiment illustrating another way to pivot legs forward and another area to attach the roller and tensioning means. This embodiment differs from that of FIG. 1, because spacing bars 148 and 150 now attach to legs 37 and 38, and forward and backward pivot motion occurs at the attachment juncture 196 and 197. The attachment juncture 196 and 197 is pivotal or rotatable and secures spacing bars 148 and 150 to legs 37 and 38. Axle 190 acts as axle for momentum weight 202 and wind load simulator fan 194. Axle 190 also acts as a rotatable roller to be engaged by a bicycle tire. Threads 194 on axle roller 190 threadably engage and disengage wind load simulator 192 to offer the option of having wind tension. Bolts 198 and 200 attach roller axle to spacing bars 148 and 150. Roller axle 190 consists of a hollow bar journaled onto an internal axle by means of rotational bearings. Element 173 are securing holes and bolts that secure frame to the floor surface. Element 39 is latchbolt detante that cooperates with hole 41 of FIG. 4 to lock quick release in place. Element 64 is the same tensioning device of FIG. 6 and works in the same manner to tension momentum weight. Momentum weight 202 is used to simulate actual road conditions, e.g., when pedaling a bicycle down a street and one suddenly stops pedaling, momentum keeps the wheels moving. This weight 202 accomplishes somewhat the same affect when on a trainer; it keeps the wheel from coming to an abrupt stop when pedaling is stopped. In FIG. 1, roller 2 acts as momentum weight.

The embodiment of FIG. 13 takes advantage of the popular wind load simulator, yet gives the option of using quieter tensioning device 67. Pivot action of upright legs 37 and 38 actually moves rear base support 141 forward or backward while the front base support remains stationary.

As this invention may be embodied in several forms without departing from the spirit or essential characteristics thereof, the present embodiment is therefore illustrative and not restrictive, and since the scope of the invention is defined by the appended claims, all changes that fall within the metes and bounds of the claims or that form their functional as well as their conjointly cooperative equivalents are therefore intended to be embraced by those claims.

What I claim as my invention is:

1. A quick release mechanism for a stand that engages the hub area of a bicycle wheel, comprising:

(a) a housing adapted to slidably receive a first piston, wherein said housing is mounted on a first hub supporting leg;

(b) a first piston nesting within the housing and being slidable therein, wherein said first piston has a first end bearing a bicycle hub capturing socket for capturing the first side of said bicycle wheel hub, and wherein said first piston has a second end bearing a camming surface;

(c) a cam pivotally mounted on said housing in close proximity to the camming surface of said first piston, whereby said cam acts upon said camming surface of said first piston to urge the first end towards the hub of a bicycle, said cam further comprising a lever attached to said cam for manually pivoting the cam;

(d) means for capturing the second side of said bicycle wheel hub mounted on a second hub supporting leg, wherein the hub supporting legs are mutually spaced to allow for a bicycle wheel to be located and captured therebetween.

2. The apparatus of claim 1 further comprising locking means to lock the cam in place.

3. The apparatus of claim 2 where the locking means further comprises cooperating holes located on the housing and the cam to accommodate a detent.

4. The quick release mechanism of claim 1 further comprising:

(a) a spring attached to said first piston and said housing to resist urging of the first piston towards the hub of a bicycle and to follow the cam when it is moved out of contact with the camming surface.

5. The quick release mechanism of claim 1 wherein said means for capturing the second side of said bicycle wheel hub comprises an axially movable second piston having a hub capturing socket located thereon, wherein said axially movable second piston has threads on an outside surface, wherein said axially movable second piston is threadably received in said bicycle wheel hub support means, whereby said axially movable second piston moves towards and away from the hub by rotating the axially movable second piston.

* * * * *